US006086458A

United States Patent [19]

Miyamoto et al.

[11] Patent Number: 6,086,458

[45] Date of Patent: Jul. 11, 2000

[54] DRILL POLISHING METHOD AND ITS CENTERING TOOL

[75] Inventors: Hitoshi Miyamoto; Yutaka Miyamoto, both of Miki, Japan

[73] Assignee: Miyamoto Engineering Co., Ltd., Hyogo-Ken, Japan

[21] Appl. No.: 08/956,018

[22] Filed: Oct. 22, 1997

[30] Foreign Application Priority Data

Dec. 4, 1996 [JP] Japan ..... 8-340624

[51] Int. Cl.[7] ..... B24B 1/00

[52] U.S. Cl. ..... 451/48; 451/65; 451/279; 451/282

[58] Field of Search ..... 451/279, 278, 451/282, 48, 65

[56] References Cited

U.S. PATENT DOCUMENTS

| | | | |
|---|---|---|---|
| 3,553,898 | 1/1971 | Nobile . | |
| 3,656,264 | 4/1972 | Mackey, Jr. et al. | 51/288 |
| 5,070,654 | 12/1991 | Manqvist et al. | 51/120 |
| 5,400,546 | 3/1995 | Christian et al. | 451/143 |
| 5,649,853 | 7/1997 | Kuo | 451/178 |
| 5,735,732 | 4/1998 | Bernard | 451/242 |

FOREIGN PATENT DOCUMENTS

| | | |
|---|---|---|
| 146266 | 10/1989 | Japan . |
| 9-155698 | 6/1997 | Japan . |
| 9-155699 | 6/1997 | Japan . |

*Primary Examiner*—David A. Scherbel
*Assistant Examiner*—Dung Van Nguyen
*Attorney, Agent, or Firm*—Birch, Stewart, Kolasch & Birch, LLP

[57] ABSTRACT

A plurality of centering parts 13 corresponding to drill diameters are disposed in a drill centering tool 3 and the drill centering tool 3 is supported at the side of a drill polishing machine 1. A drill 2 to be polished can be easily and accurately centered in the centering part 13 of the drill centering tool 3. In particular, the drill 2 is centered by fitting the front end portion of the spiral drill groove 14 of the drill 2 to a centering pawl 15 of the drill centering tool 3, chucking the centered drill 2 in a drill chuck 4 of the drill polishing machine 1, and polishing by fitting the cutting edge 5 to be polished at the front end of the drill 2 to the polishing surface of a grinder. Even if the drill diameters are different, drills to be polished can be easily centered and polished.

11 Claims, 6 Drawing Sheets

DRILL POLISHING METHOD AND ITS CENTERING TOOL

BACKGROUND OF THE INVENTION

1. Technical Field of the Invention

The present invention relates to a drill polishing method and a centering tool therefor in the field of machine tools and drilling. More particularly, the present invention relates to a drill polishing method and centering tool therefor capable of polishing precisely by accurately centering the drill to be polished.

2. Description of Related Art

Hitherto, U.S. Pat. No. 3,553,898 and Japanese Patent Publication No. 1-46266 have been known as drill polishing machines for polishing the tip of the drill used in a machine tool or drilling.

However, according to the U.S. Pat. No. 3,553,898, the drill is inclined by a specific angle on the rotary shaft of the grindstone and is moved on the slide, and the drill holder must be held in hand while sliding. However, after polishing one tip of the end of the drill, the drill must be detached, inverted by 180 degrees and polished again. This has taken too much time and labor, and the precision was not sufficient.

According to the latter Japanese Patent Publication No. 1-46266, in addition to the above type, a holder for holding the drill is supported on the slide base by rotating 180 degrees. Therefore, the efficiency of the drill polishing job is enhanced.

In these drill polishing methods, nevertheless, the drill holder shaft is set at a specific angle on the rotary shaft of the grindstone, and it is intended to polish while setting the tightening surface of the drill holder at a specific angle to the horizontal plane.

Accordingly, not centering accurately on the basis of the spiral grooves at both sides of the drill to be polished, it was difficult to polish the flank or thin the chisel always at a specific angle to the chisel.

The present applicant already proposed, in Japanese Patent Application No. 7-345599, a method of polishing the flank of the drill tip and thinning the chisel, in one chucking operation, the drill to be polished. However, since the chisel width differs from the diameter of the drill, it was difficult to polish by centering the drills differing in diameter accurately.

SUMMARY OF THE INVENTION

The present invention is devised in the light of the above background, and to solve the above problems. It is an object thereof to present a drill polishing method characterized by disposing a plurality of centering parts corresponding to drill diameters in accordance with the drill diameters to be polished in a drill centering tool, centering a drill to be polished by the centering part suited to the drill diameter, chucking the centered drill in a drill chuck of a drill polishing machine, fitting the cutting edge to be polished at the end of the drill tightly to the polishing surface of a grinder, and polishing.

Accordingly, any drill to be polished can be easily and accurately centered by a drill centering tool of a specified diameter, and the centered drill is chucked in a drill chuck of a drill polishing machine. In addition, the cutting edge can be polished by fitting tightly to the polishing surface of a grinder, so that any drill can be polished easily and precisely by anyone.

It is another object of the present invention to present a drill polishing method characterized by fitting a centering pawl of a drill centering tool tightly to the front end portion of a spiral drill groove of a drill, positioning the chisel of the cutting edge to be polished of the drill by turning to a specified position of a grinder by a turning positioning mechanism of a drill polishing machine so as to chuck in a drill chuck of the drill polishing machine at a specified angle position, and polishing the flank of the cutting edge of the drill or thinning the chisel.

Accordingly, by positioning the drill chucked in the drill chuck after centering by turning to a specified position of a grinder by the turning positioning mechanism of the drill polishing machine, and polishing the flank of the cutting edge of the drill or thinning the chisel, both polishing of the flank of the cutting edge of the drill and thinning of the chisel can be done precisely. In addition, it is possible to polish in one chucking operation by rotating the drill chuck by 180 degrees.

It is a further object of the present invention to present a drill polishing method and a centering tool therefor characterized by disposing a plurality of centering parts corresponding to the drill diameters radially according to the drill diameters to be polished in a drill centering tool, supporting the drill centering tool to the side of a drill polishing machine, and centering the drill by selecting the centering part of the drill of the specified diameter by turning the drill centering tool corresponding to the drill diameter of the drill to be polished.

Accordingly, by centering the drill to be polished easily and accurately by the drill centering tool for a specified diameter, chucking the centered drill in the drill chuck of the drill polishing machine, fitting the cutting edge tightly to the polishing surface of a grinder, and polishing, polishing of the drill can be performed easily and precisely by anyone. Therefore, if the drill diameters are different, drills to be polished can be easily centered and polished.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
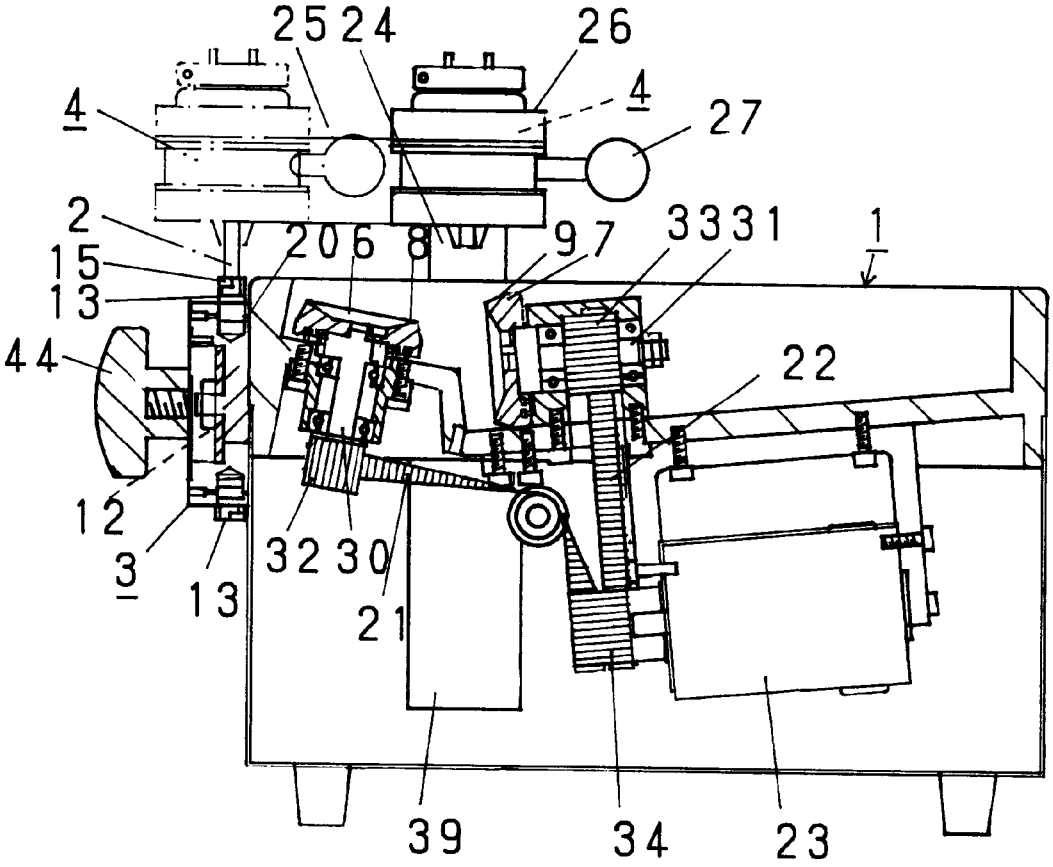
FIG. 1 is a partially omitted side sectional view of an embodiment of a drill polishing machine of the present invention.

A drill polishing method and a centering tool therefor of the present invention are characterized by disposing a plurality of centering parts corresponding to drill diameters in a drill centering tool, centering the drill to be polished in the centering part of the drill centering tool corresponding to the drill diameter, chucking the centered drill in a drill chuck of a drill polishing machine, and polishing by fitting the cutting edge to be polished at the front end of the drill tightly to the polishing surface of a grinder.

A drill polishing machine 1 of the present invention comprises, as shown in FIG. 1 through FIG. 5, a centering tool 3 for a drill 2 at its side, and is designed to chuck the centered drill 2 in a drill chuck 4, fit a cutting edge 5 at the front end of the drill 2 tightly opposite to polishing surfaces 8, 9 of grinder 6, 7, and polish flanks 10 of the cutting edge 5 of the drill 2 and thin chisels 11, precisely in one chucking operation.

Figure 6:
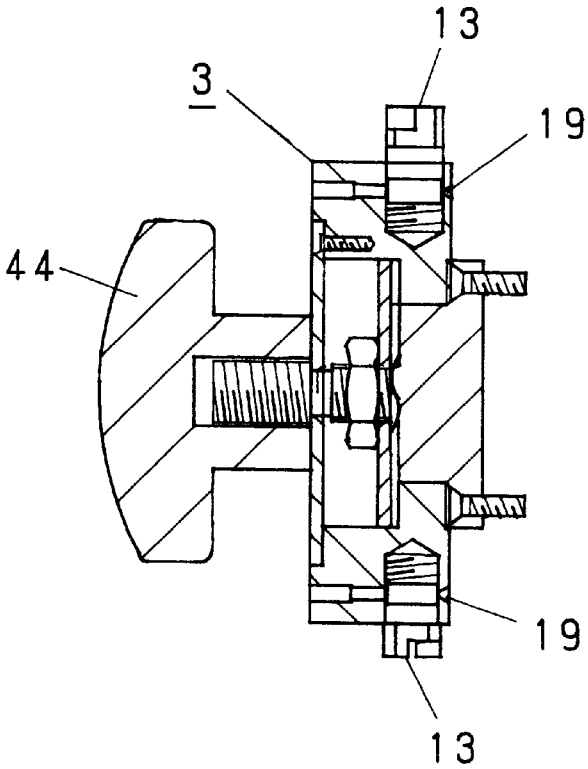
FIG. 6 is a side sectional view of a drill centering tool of the same.
Figure 7:
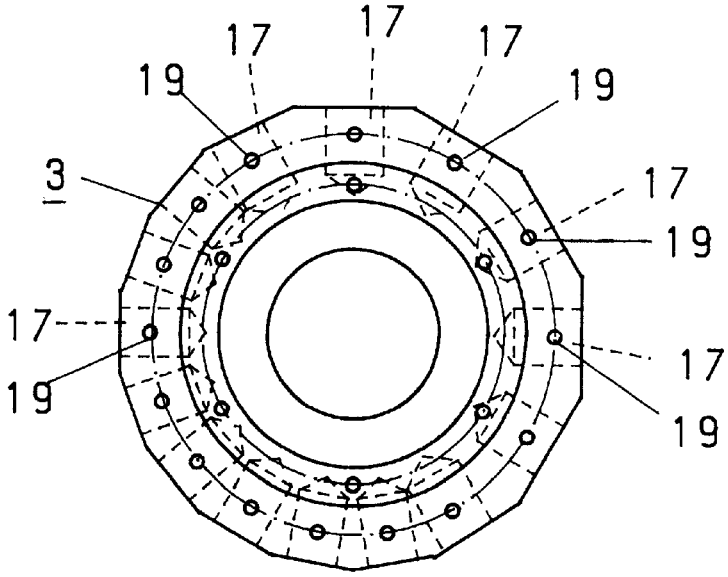
FIG. 7 is a partially omitted side sectional view of the same drill centering tool.

The drill centering tool 3 is supported rotatable about a horizontal fixed shaft 12, for example, as shown in FIG. 1. Each centering part 13 is disposed radially, as shown in FIG. 6 and FIG. 7, so as to center accurately corresponding to the drills to be polished, especially, drills 2 having a small diameter of 1 to 13 mm. By inserting the drill 2 to be polished into the centering part 13 positioned above, it is designed to center easily and precisely as specified.

Figure 8A:
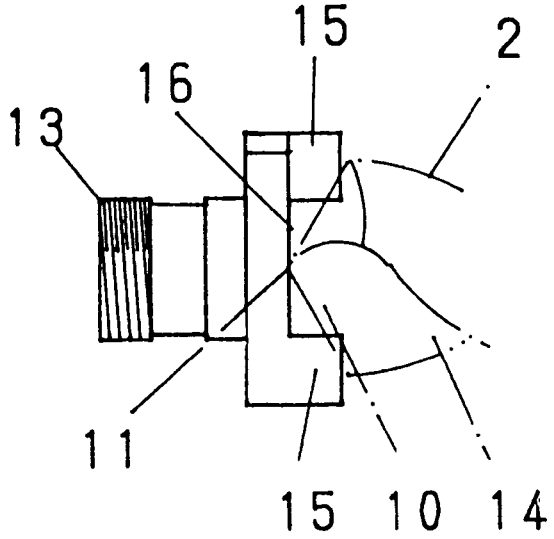
FIGS. 8*a* and 8*b* are magnified views for explanation of centering pawls of the same.
Figure 8B:
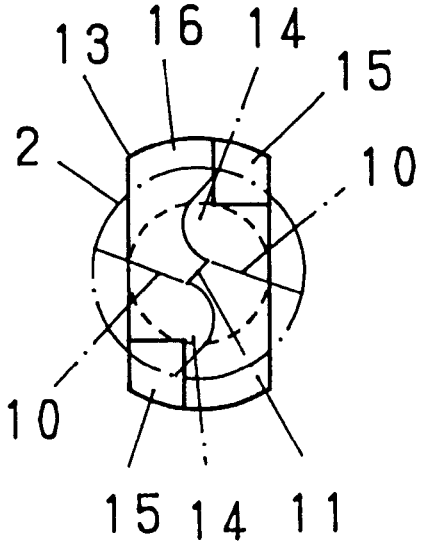
Figure 9A:
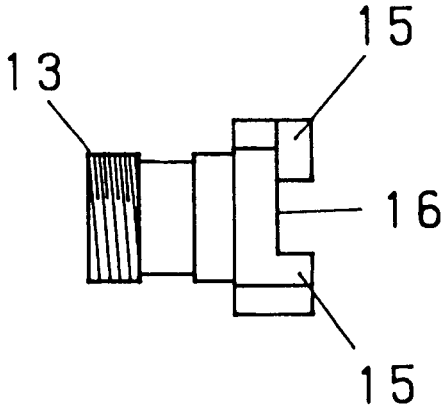
FIGS. 9*a* and 9*b* are magnified views for explanation of the same centering pawls.
Figure 9B:
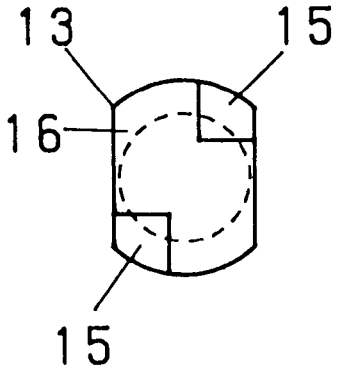

In each centering part 13, as shown in FIG. 8 and FIG. 9, axis-symmetrical angular centering pawls 15 are disposed at a specified interval so as to center by abutting against a spiral drill groove 14 at both sides or one side of the front end of the drill 2 of a specified diameter. The drill 2 is inserted into the centering part 13, and thereby the drill 2 abutting against its bottom 16 can be centered precisely so that its chisels 11 may be always at a specific angle.

Each centering part 13 is inserted into an opening 17 opened at an angle interval of 20 degrees or 30 degrees in the periphery of the polygonal centering tool 3 as shown in FIG. 7, and is adjusted and fixed at a specified position by a fixing tool (not shown) so as to center as described above.

The centering parts 13 may be formed integrally by cutting out centering pawls 15 in the periphery of the drill centering tool 3.

In the centering tool 3, positioning holes 19 are opened at the back side as shown in FIG. 6 and FIG. 7. In one of the positioning holes is fitted a positioning part 20 of a ball plunger elastically projecting to the drill polishing machine 1 side as shown in FIG. 1, so as to be stopped accurately at the specified position like an index table.

In the drill polishing machine 1 having the drill centering tool 3 at a side thereof, as shown in FIG. 1, disc grinders 6, 7 are disposed at an inclination by a specific angle in the horizontal direction and vertical direction. In addition, timing belts 21, 22 are suspended between the grinders 6, 7 and a driving motor 23. Therefore, the disc grinders are designed to polish the drill by rotating and driving the driving motor 23 at a predetermined speed.

Figure 2:
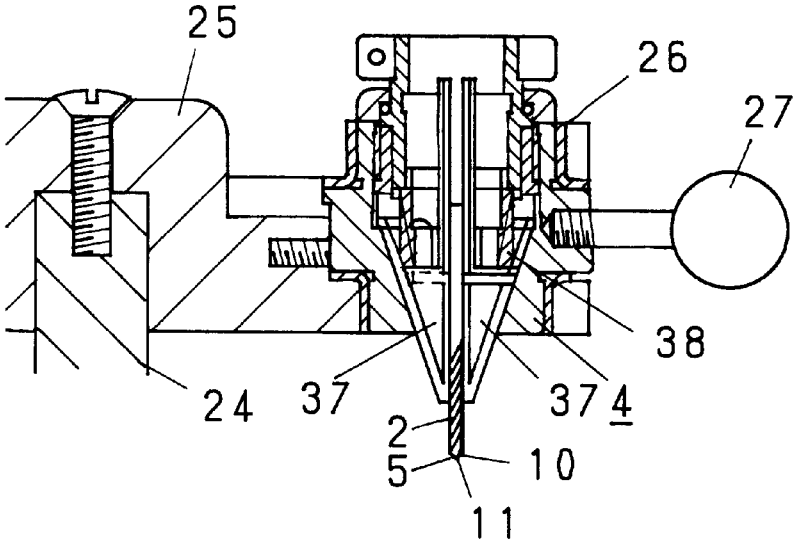
FIG. 2 is a side sectional view of an arm unit and drill chuck unit of the same.

As shown in FIG. 1 and FIG. 2, a support shaft 24 is vertically disposed on the drill polishing machine 1. A chuck holder 26 is fitted to the support shaft 24 by rotatably fitting an arm unit 25 of a specified length. Furthermore, the drill chuck 4 is detachably fitted to the chuck holder 26 which can be rotated by 180 degrees by a chuck handle 27. Incidentally, the drill chuck 4 is installed in the chuck holder 26 at an inclination by a specific angle, so that the rake angle of the cutting edge or the clearance angle of the flank 10 may be set. If necessary, it may be inclined to the support shaft 24.

Figure 4:
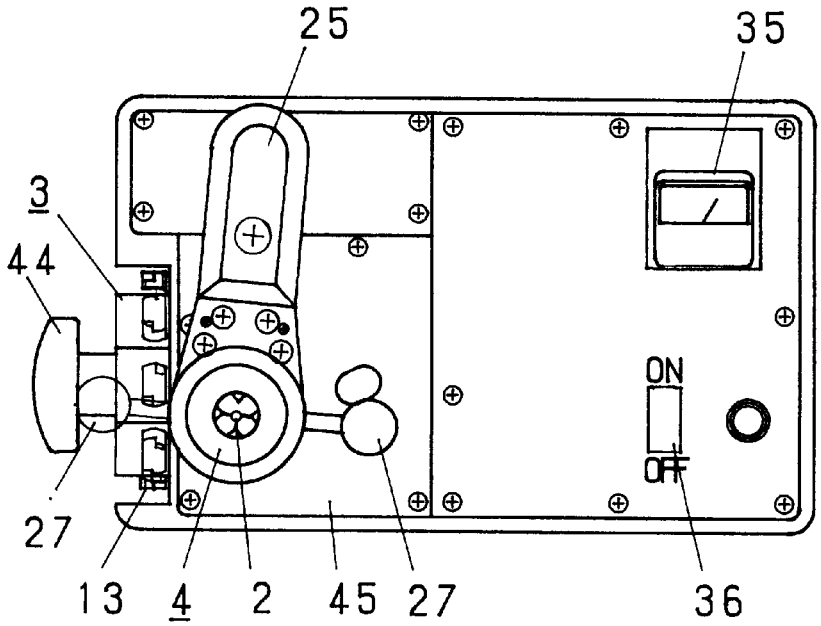
FIG. 4 is a plan view of a flank polishing state of the same drill polishing machine.
Figure 5:
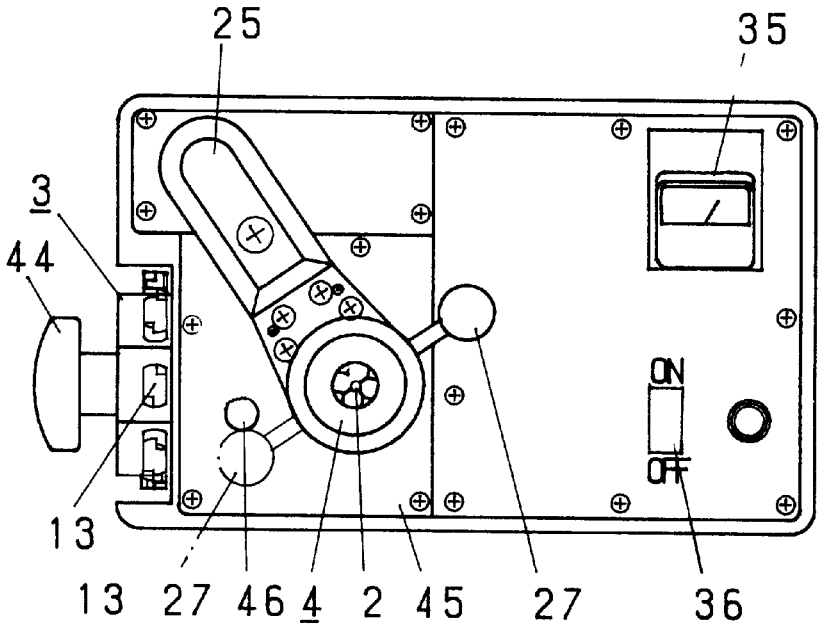
FIG. 5 is a plan view of a thinning state of the same drill polishing machine.

In such a drill chuck 4, the centered drill 2 is inserted and chucked, and the arm unit 25 is turned by a specific angle as shown in FIG. 4 and FIG. 5. The front end of the drill 2 is fitted to the polishing surfaces 8, 9 in an angle form on the periphery of the grinders 6, 7, thereby polishing the flank 10 of the cutting edge 5 and thinning the chisel 11.

The disc grinders 6, 7 are identical in shape and dimension. Polishing of the flank 10 of the cutting edge 5 is achieved by the inner side at one side of the angle form. Thinning of the chisel 11 is achieved by the outer side at one side of the angle form. When the polishing surfaces reach the end of their service life, the mounting positions are exchanged, so that the life of the disc grinders 6, 7 may be doubled.

Figure 10:
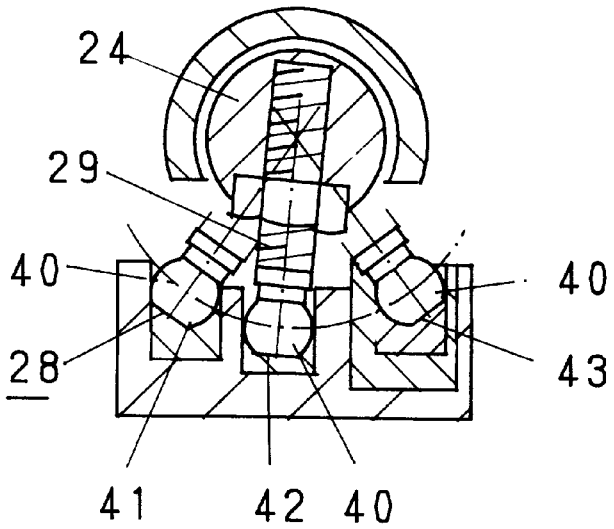
FIG. 10 is a flat sectional view of an arm unit turning positioning unit of the same.
Figure 11:
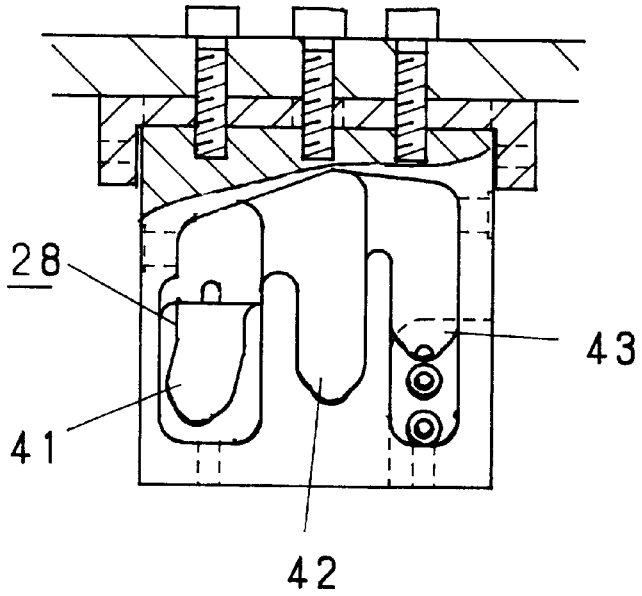
FIG. 11 is a partially omitted side sectional view of the same.

As the turning positioning mechanism of the arm unit 25, for example, as shown in FIG. 10 and FIG. 11, positioning grooves 28 such as automotive speed change means are provided at the centering position of the drill 2, the flank polishing position, and the thinning position. Positioning tools 29 may be inserted into the positioning grooves 28.

In the grinders 6, 7, as shown in FIG. 1, timing gears 32, 33 are provided on drive shafts 30, 31. The timing gears 32, 33 are operatively connected to a timing gear 34 of one driving motor 23 by the timing belts is 21, 22. The grinders 6, 7 are driven at a specified rotating speed by the driving motor. An ammeter 35 is electrically connected so as to polish the drill at a proper load while checking the current of the driving motor 23. Reference numeral 36 is a power switch.

Figure 3:
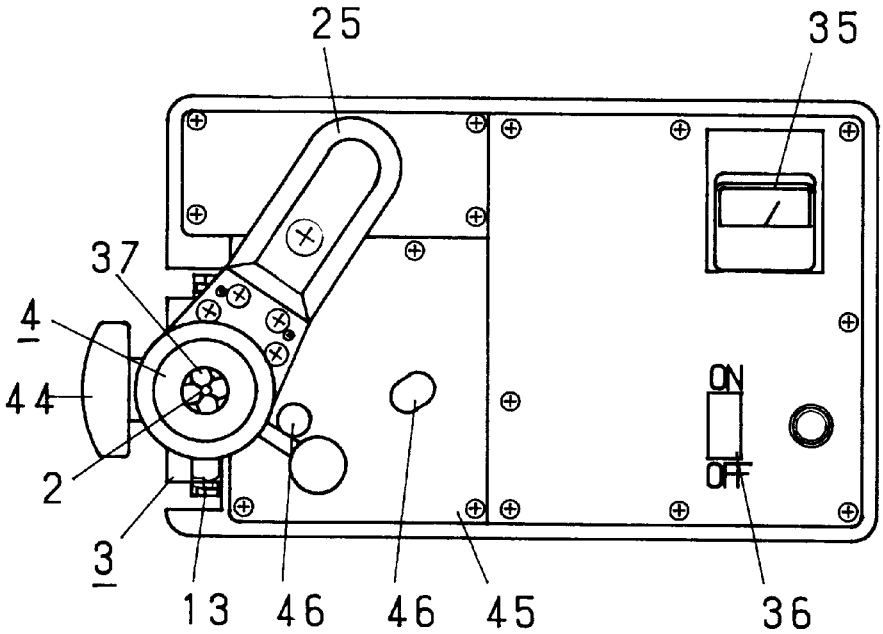
FIG. 3 is a plan view of a chuck state of a centering drill of the same drill polishing machine.

FIG. 1 and the following show an embodiment of the invention. In the drill polishing machine 1, as shown in FIG. 1 through FIG. 3, the disc grinder 6 has a peripheral part for polishing the flank 10 of the cutting edge 5 at the upper side which is formed as a polishing surface 8 of a specified angle form. The disc grinder 6 is inclined by a specific angle from the horizontal plane. The disc grinder 7 has the same dimensions and shape as the disc grinder 6. The disc grinder 7 has a peripheral part for thinning the chisel 11 at the side portion which is formed as a polishing surface 9 of a specified angle form and is inclined by a specific angle from the vertical plane. Rotating and driving of the disc grinders 6, 7 at a specific rotating speed through the timing belts 21, 22 is performed by the driving motor 23 built in the drill polishing machine 1.

In the rear portion, as shown in FIG. 1 through FIG. 3, the arm unit 25 of the chuck holder 26 is affixed to the upper end of the support shaft 24 which is disposed vertically. The drill chuck 4 having four pawls is detachably fitted to this chuck holder 26 as shown in FIG. 2, and the drill chuck 4 can be rotated by 180 degrees by the chuck handle 27.

The drill chuck 4 is fitted in a pawl holder 38 so as to expand four chuck pawls 37 mutually oppositely as shown in FIG. 2 and FIG. 3. The length of the chuck portion of the chuck pawls 37 is defined at more than 1.5 times the lead pitch of the diameter of the drill to be chucked (maximum drill diameter if necessary), so that the drill 2 may be polished while being chucked thinly to prevent deviation.

The support shaft 24 is built in a support pipe 39 as shown in FIG. 1, and is disposed so as to be pushed downward, resisting a spring member of a coil spring. A positioning tool 29 for turning is horizontally projected as shown in FIG. 10. A spherical fitting part 40 is fitted at its end in the specified positioning groove 28, so as to be positioned accurately at a specified angle position by turning the chuck holder 26.

The positioning grooves 28 are disposed oppositely to the positioning tool 29, and are positioned accurately at each position of the drill centering part 41, flank polishing position part 42, and thinning polishing position part 43. The positioning grooves 28 are opened in inverted hill forms like a changeover speed change clutch of an automobile as shown in FIG. 10 and FIG. 11. In particular, each positioning groove 28 has a V-section in the abutting portion so as to enhance the centering precision by point contact with the spherical surface of the spherical fitting portion 40 of the positioning tool 29 as shown in FIG. 11.

At the side of the drill polishing machine 1, the drill centering tool 3 such as a hexapentagonal index table as shown in FIG. 6 or FIG. 7 is supported. The arm unit 25 is turned to the position of the drill centering tool 3 as shown in FIG. 3, so that the drill 2 centering the chisels 11 in specified direction can be installed in the drill chuck 4.

The drill centering tool 3 is to center each drill 2 of 1 to 13 mm in diameter necessary for small tools by fitting the centering pawls 15 to the drill grooves 14 at both sides, and by turning a knob 44. The drill 2 is inserted and centered in the centering part 13 having a specified diameter selected to the upper side at the positioning part 20 of a ball plunger. The centered drill 2 is then chucked in the drill chuck 4.

By turning the arm 25, the drill chuck 4 is pushed down at the flank polishing position 42 of the positioning groove 28 as shown in FIG. 4, and inserted into a drill inserting part 46 opened in the cover 45. The drill abuts against the peripheral polishing surface 8 of the disc grinder 6 and is polished. The polishing pressure can be adjusted while checking the ammeter 35 of the driving motor 23.

When the flank 10 of one side of the cutting edge 5 is polished, by raising the drill chuck 4 slightly, the drill chuck 4 is rotated by 180 degrees at this position by turning the chuck handle 27 by 180 degrees, and is pushed down again, and the flank 10 of the cutting edge 5 at the other side of the drill 2 is polished.

Consequently, by turning the arm unit 25, when the drill chuck 4 is pushed down at the thinning position 41 as shown in FIG. 5, the cutting edge 5 abuts against the polishing surface 9 of the disc grinder 7, and is thinned. In this case, too, by rotating the drill chuck 4 by 180 degrees, the other side can be thinned.

Therefore, the drill can be centered easily and accurately by anyone, and both thinning and polishing of the flank of the drill cutting edges can be done precisely in one chucking operation.

In particular, by setting plural drill centering parts in the drill centering tool, each drill having a diameter of 1.0 mm can be centered easily, and polished. If necessary, the drill centering tool can be applied to a drill having a diameter of less than 1 mm or more than 13 mm.

The disc grinders 6, 7 may have polishing surface shapes corresponding to polishing of the flank 10 of the cutting edge 5 in a linear form or angle form of the drill 2, and corresponding to thinning of the chisels 11.

The above stated index table shape of the drill centering tool is only an example. Linear, circular or other proper arrangement mechanisms may be employed.

The drill chuck of the embodiment may be of collet type, or it may be also applied to a key-drive or key-less drill chuck, and it maybe modified freely within the scope of the invention.

Moreover, in the embodiment, grinders are each disposed in a horizontal position and vertical position, and exchanged when worn, but two of them may be also disposed symmetrically on both sides in the vertical position so as to thin at the right and left side, or by disposing a plurality symmetrically, and turning the drill to a specified position, the required cutting edge and thinning surfaces can be polished.

Thus, in the present invention, any drill to be polished can be easily and accurately centered by a drill centering tool of a specified diameter. The centered drill is chucked in a drill chuck of a drill polishing machine, and the cutting edge is polished by fitting tightly to the polishing surface of a grinder, so that any drill can be polished easily and precisely by anyone.

In particular, by fitting the front end portion at both sides of the spiral drill groove of the drill to the centering pawls provided axis-symmetrically in the centering part, and centering the drill, the dull can be centered precisely and securely, and the drill can be polished.

By positioning the drill chucked in the drill chuck after centering by turning to a specified position of a grinder by the turning positioning mechanism of the drill polishing machine, and polishing the flank of the cutting edge of the drill and thinning of the chisel can be done precisely, and it is possible to polish in one chucking operation by rotating the drill chuck by 180 degrees.

Furthermore, by disposing a plurality of centering parts corresponding to the drill diameters radially according to the drill diameters to be polished in a drill centering tool, supporting the drill centering tool to the side of a drill polishing machine, and centering the drill by selecting the centering part of the drill of the specified diameter by turning the drill centering tool corresponding to the drill diameter of the drill to be polished, if the drill diameters are different, drills to be polished can be easily centered and polished.

Furthermore, by defining the length of the chuck of four chuck pawls of the drill chuck at more than the lead pitch of 1.5 times the drill diameter to be chucked, and polishing by chucking the drill at the lead portion, the drill of small diameter can be chucked tightly and polished accurately.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A drill polishing method comprising the steps of:

supporting a drill centering tool at a side of a drill polishing machine;

disposing a plurality of centering parts corresponding to different drill diameters in the drill centering tool;

centering a drill to be polished in the centering part of the drill centering tool corresponding to the drill diameter;

chucking the centered drill in a drill chuck of a drill polishing machine; and polishing the drill by fitting a cutting edge to be polished at a front end of the drill to a polishing surface of a grinder.

2. The drill polishing method of claim 1, further comprising the steps of:

radially disposing a plurality of centering parts corresponding to the drill diameters in a drill centering tool according to the drill diameters to be polished;

turning the drill centering tool corresponding to the drill diameter of the drill to be polished to select the centering part of the drill of the selected diameter; and centering the drill in a drill chuck of the drill polishing machine.

3. The drill polishing method of claim 1, wherein the step of centering the drill further includes the step of fitting a front end portion of a spiral drill groove of the drill to a centering pawl of the drill centering tool.

4. The drill polishing method of claim 1, wherein the step of centering the drill further includes the step of fitting front end portions at both sides of a spiral drill groove of the drill to centering pawls provided in the drill centering tool.

5. The drill polishing method of claim 1, further comprising the steps of:

disposing disc grinders in a drill polishing machine at specified positions; turning and positioning the drill centered and chucked in the drill chuck by a turning positioning mechanism of the drill polishing machine; and polishing a flank of the cutting edge of the drill and thinning a chisel of the drill.

6. The drill polishing method of claim 5, further comprising the step of inverting the drill chuck by 180 degrees at a flank polishing position of the drill cutting edge or chisel thinning position, and the polishing step further includes the step of polishing right and left side flanks of the drill and thinning the chisel of the drill in one chucking operation of the drill chuck.

7. The drill polishing method of claim 6, further comprising the step of providing four chuck pawls in a pawl holder accommodated in a drill chuck so as to be expandable mutually oppositely in each pair in order to chuck and polish drills of small diameters in a range of 1.0 to 13 mm, a length of a chuck of the chuck pawls is defined more than a lead pitch of 1.5 times a diameter of the drill to be chucked.

8. The drill polishing method of claim 1, wherein disc grinders are disposed in the drill polishing machine at predetermined positions for polishing a flank of the drill cutting edge and thinning a chisel of the drill, said disc grinders are of the same shape and dimensions, and wherein the step of polishing further comprises the step of polishing the flank of the drill cutting edge by one side of a periphery of one of the disc grinders, and further comprising the steps of:

thinning the chisel of the drill cutting edge by an opposite side of a periphery of the other disc grinder; and exchanging the mounting positions of the disc grinders when the polishing surfaces of the disc grinders are worn in order to perform polishing and thinning with opposite sides of the respective disc grinders.

9. An apparatus for drill polishing comprising:

a drill centering tool provided at a side of a drill polishing machine;

a centering pawl of the drill centering tool is disposed to be fitted to a front end portion of a spiral drill groove of a drill, a chisel of a cutting edge to be polished of the drill is chucked in a drill chuck of the drill polishing machine at a predetermined angle;

a plurality of centering parts corresponding to different drill diameters are disposed radially in the drill centering tool according to the drill diameters to be polished; and wherein the drill centering tool is turned to select a centering part corresponding to the drill diameter of the drill to be polished and to center the drill.

10. The apparatus for drill polishing of claim 9, wherein centering pawls are disposed at specified positions of the drill centering tool so that a front end of the centering pawls may abut against predetermined positions of the drill groove in a front end portion of the drill having the drill diameter to be polished.

11. The apparatus for drill polishing of claim 10, wherein centering pawls are disposed at predetermined positions of the drill centering tool.

* * * * *